US008181776B2

(12) United States Patent
Taggart et al.

(10) Patent No.: US 8,181,776 B2
(45) Date of Patent: May 22, 2012

(54) BILLIARD BALL TRAY AND CASE

(75) Inventors: Terry A. Taggart, Parker, CO (US); Kyle A. Taggart, Aurora, CO (US); Charles Dittrick, Aurora, CO (US); Steve Braun, Centennial, CO (US); Walter Braun, Jr., Centennial, CO (US)

(73) Assignee: Taggart Enterprises, Inc., Parker, CO (US)

( * ) Notice: Subject to any disclaimer, the term of this patent is extended or adjusted under 35 U.S.C. 154(b) by 0 days.

(21) Appl. No.: 12/884,817

(22) Filed: Sep. 17, 2010

(65) Prior Publication Data

US 2011/0297576 A1 Dec. 8, 2011

Related U.S. Application Data

(60) Provisional application No. 61/351,179, filed on Jun. 3, 2010.

(51) Int. Cl.

| | |
|---|---|
| ***B65D 85/00*** | (2006.01) |
| ***B65D 71/00*** | (2006.01) |
| ***B65D 73/00*** | (2006.01) |
| ***A63D 15/00*** | (2006.01) |

(52) U.S. Cl. ..... 206/315.9; 206/471; 206/579; 473/41

(58) Field of Classification Search ..... 206/315.1, 206/315.9, 470, 471, 579; 220/4.22, 4.23, 220/771; 473/41; D3/257; D9/415, 757
See application file for complete search history.

(56) References Cited

U.S. PATENT DOCUMENTS

| | | | | |
|---|---|---|---|---|
| 376,549 | A | 1/1888 | Reineet | |
| 3,863,919 | A | 2/1975 | Sardelli | |
| 4,103,773 | A * | 8/1978 | Haber | 206/315.9 |
| 4,494,650 | A * | 1/1985 | Cullen | 206/315.9 |
| 4,591,051 | A * | 5/1986 | Lowman | 206/315.9 |
| D315,871 | S * | 4/1991 | Whitebread | D9/757 |
| D322,166 | S * | 12/1991 | D'Angeli | D3/257 |
| 5,531,646 | A | 7/1996 | Boyle | |
| 5,556,341 | A | 9/1996 | Bonn, Jr. | |
| 5,601,496 | A | 2/1997 | Beauchamp | |
| 5,871,405 | A | 2/1999 | Sardo | |
| 5,997,404 | A | 12/1999 | Sardo | |
| 6,086,482 | A * | 7/2000 | Voden | 206/579 |
| D433,724 | S | 11/2000 | Craig et al. | |
| D483,260 | S * | 12/2003 | Calzavara | D9/757 |
| 7,666,105 | B2 | 2/2010 | Ball et al. | |
| 7,690,504 | B1 | 4/2010 | Lail | |
| 7,785,209 | B1 | 8/2010 | Targosz, Jr. et al. | |
| 2007/0191124 | A1 | 8/2007 | Thorpe | |

FOREIGN PATENT DOCUMENTS

GB 2222146 A * 2/1990

OTHER PUBLICATIONS

International Search Report and Written Opinion dated Jul. 27, 2011, PCT/US2010/049333, 9 pages.

* cited by examiner

*Primary Examiner* — Bryon Gehman
(74) *Attorney, Agent, or Firm* — Dorsey & Whitney LLP

(57) ABSTRACT

Generally, embodiments described herein take the form of a carrying tray for billiard balls, a case for billiard balls, or both. Certain embodiments may likewise carry a billiards rack, chalk or other billiards items. An embodiment may be generally triangle-shaped. Other embodiments may be square-shaped, rectangular shaped or rounded in shape. One or more protrusions, such as a handle or base, may project from the main body of the tray or case. The interior of the tray or case defines a number of features for carrying the billiard balls and billiards rack.

17 Claims, 16 Drawing Sheets

BILLIARD BALL TRAY AND CASE

CROSS REFERENCE TO RELATED APPLICATIONS

This application claims the benefit of priority under 35 U.S.C. §119(e) to U.S. Patent Application No. 61/351,179 entitled "Billiard Ball Tray and Case" filed Jun. 3, 2010, which is hereby incorporated by reference in its entirety.

TECHNICAL FIELD

Embodiments disclosed herein relate generally to cases, and more particularly to trays and cases for billiard balls.

BACKGROUND DISCUSSION

Billiards, in one form or another has been played the world over for more than a hundred years. The game commonly known as "pool" is a modern descendent of an older game. Regardless of the version, billiards is commonly played on a specialized table with a set of spherical balls, a stick (or "cue") and a rack. Generally, modern pool uses a triangular rack into which fifteen balls are fitted. The cue ball is a sixteenth ball, generally of the same size and shape as the other fifteen. Accordingly, a modern pool set includes sixteen total balls. When playing alternative forms of pool, such as eight-ball, nine balls may be used (eight balls plus the cue ball). Even so, most pool sets still include sixteen balls as some may be omitted to play eight-ball or other variants.

Typically and as seen in billiards halls the world over, a square 4×4 tray is used to carry and store billiard balls. The balls and rack are often stored separately, with the rack hanging from or stored at a billiards table and the balls in the aforementioned square tray. This works well for billiards halls, where customers retrieve the balls (in the tray) from a clerk and carry them to the table, where the rack awaits.

However, the square billiards ball tray and separately stored triangular rack may be less efficient when a person has their own billiards set and desires to transport it from one place to another. In such a situation, the owner generally carries the rack and billiard balls (in tray or square case) separately.

Further, trays, racks and chalk are often subject to theft from billiards halls. Theft of racks and chalk may be difficult to detect immediately since the chalk and racks may be left at a pool table while the balls and tray are returned. However, it can be inconvenient to store both racks and balls since more storage space is generally required.

Accordingly, what is needed is an improved billiard ball tray and case.

SUMMARY

One embodiment takes the form of an apparatus for carrying a set of balls and a rack, including a tray having: a plurality of indentations formed in a surface of the tray, each indentation at least partially spherical and configured to receive a ball; a feature formed in the surface of the tray and about at least two of the plurality of indentations, the feature sized to receive a rack; and a handle formed in the surface of the tray. In certain embodiments, the feature is a triangular-shaped groove and configured to receive a triangular rack. Further, each of the indentations may include a convex base. Likewise, in certain embodiments each of the convex bases may extend upwardly and at least partially into the indentation.

Another embodiment may take the form of a case for carrying a set of billiard balls and a billiards rack, including a tray and a cover, wherein: the tray and cover are removably attached to one another; each individual ball of the set of billiard balls is held within the case when the tray and cover are attached to one another; and the billiards rack is carried within the case when the tray and cover are attached to one another.

DETAILED DESCRIPTION

Generally, embodiments described herein take the form of a carrying tray and/or case for billiard balls. Certain embodiments may likewise carry a billiards rack, chalk and/or other billiards items. One embodiment of the tray and/or the case may be generally triangle-shaped. Other embodiments may be generally rounded in shape, square-shaped or rectangular-shaped or other shape that generally permits storage and/or carrying of a set of billiards balls and/or a rack and/or chalk and/or other billiards items. One or more protrusions, such as a handle or base, may project from the main body of the tray/case. Certain embodiments may include a cover and thereby form a "case" as referred to herein. Other embodiments may lack a cover and thus will be referred to as a "tray." The tray may be used by billiards halls and individuals to store and organize their billiard balls, rack, and chalk. The case may be used by individuals to carry their personal balls, rack and chalk to a billiards hall or other location, thus permitting individuals to bring along more familiar and/or higher-quality equipment.

Figure 1:
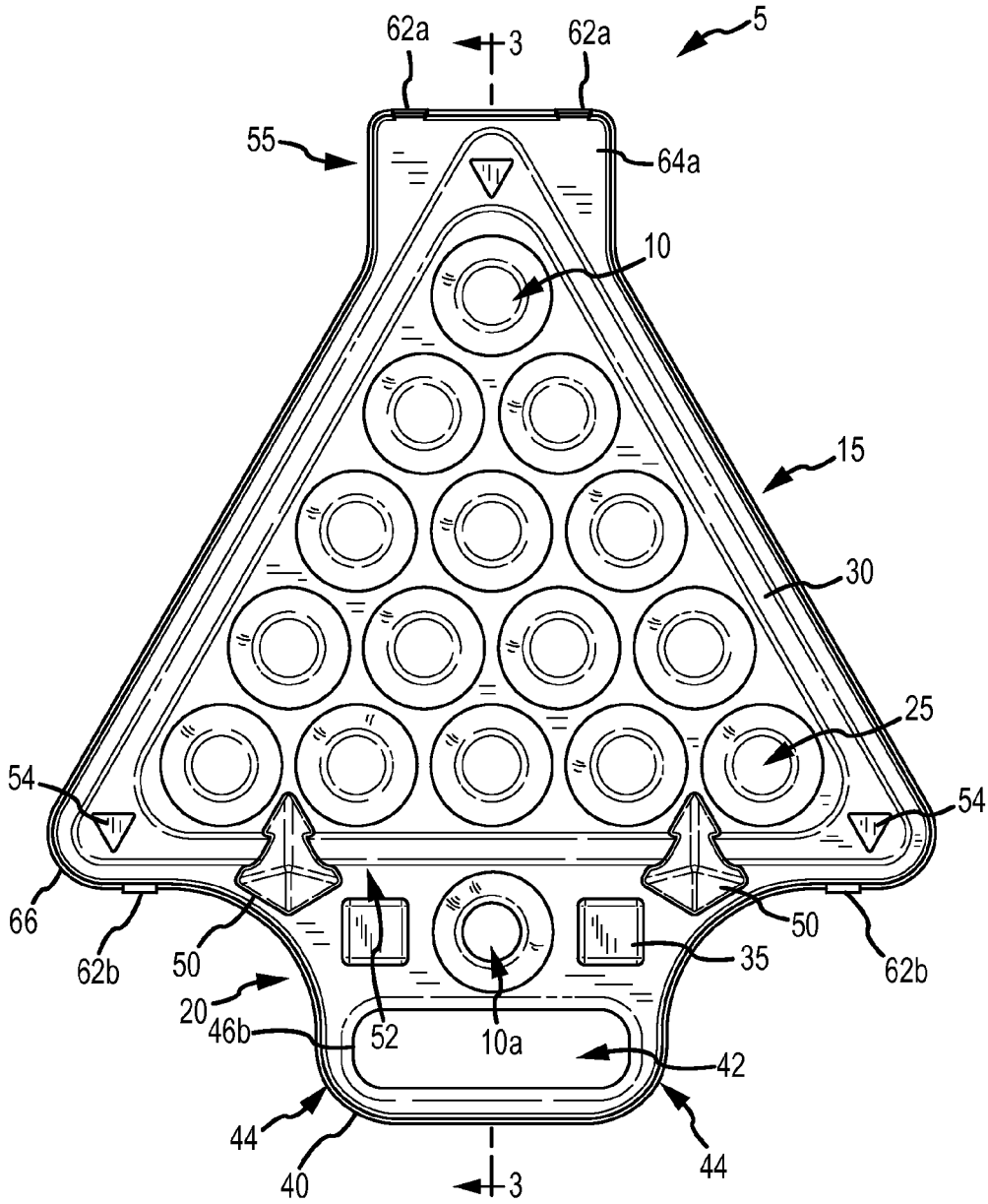
FIG. 1 depicts a top plan view of one embodiment of a billiards tray.
Figure 2:
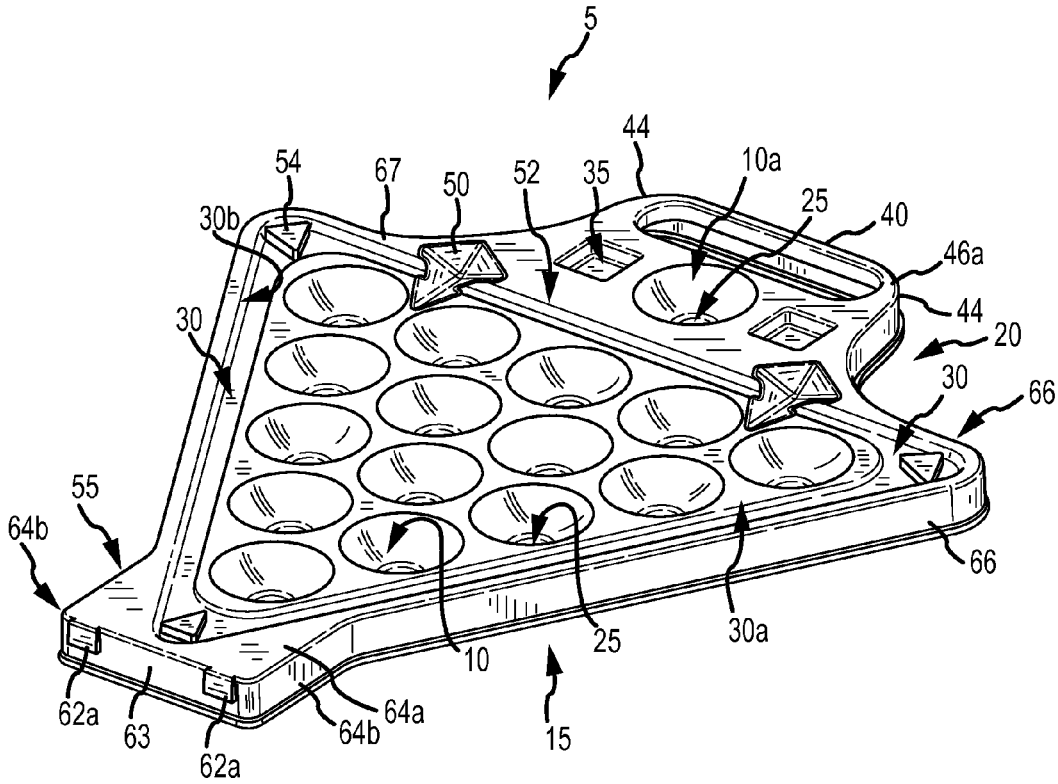
FIG. 2 depicts an isometric view of the billiards tray of FIG. 1.

FIGS. 1 and 2 show a sample tray 5 for carrying and/or storing billiard balls and a billiards rack. As shown in these figures, sixteen indentations 10 may be formed in the surface of the tray 5; each indentation 10 may accept a billiard ball. Fifteen of the indentations 10 may be within the main body 15 of the tray 5 while the sixteenth indentation 10 may be outside this main body 15 and instead defined in a supplemental area 20.

The indentations 10 are generally partially spherical and contoured to follow the shape of a billiard ball, at least in part. (Billiard balls are generally of a uniform size and shape.) Thus, when viewed from the top of the embodiment, the indentations 10 are generally concave. As shown in both FIGS. 1 and 2, the bottom or base 25 of each indentation 10 may be convex when viewed from the top of the embodiment. The convex base 25 of each indentation 10 is shown to best effect in the cross-sectional view of FIG. 3. By making the bases of each indentation convex, multiple trays with nested billiard balls may be stacked atop one another, as described in more detail below.

Returning to FIGS. 1 and 2, it can be seen that the embodiment may also accept and store a triangular billiards rack. As shown in these figures, the rack sits around the set of fifteen indentations 10 in a groove 30. Inner and outer groove sidewalls 30*a*, 30*b* define the width of the groove; the groove is sized to easily accept or configured to receive the rack but prevent or hinder the rack from sliding excessively. In some embodiments, the width of the groove 30 may approximately equal the width of the rack (e.g., each of the three sections of the groove may correspond in width to a width of each of the three sections of the triangular rack). In other embodiments and as shown, the groove 30 may be slightly wider than the rack. In yet other embodiments, the inner groove wall 30*a* may be sized to snug-fit the rack thereon.

Although FIGS. 1 and 2 show a track or groove 30 sized to accept the rack, it should be appreciated that alternative embodiments may use a pedestal or a single sidewall instead of a groove. For example, the inner groove sidewall 30*a* may remain in certain embodiments but the outer groove sidewall 30*b* may be omitted. In such an embodiment, the base of the rack might be flush with a surface of the tray.

As shown in FIGS. 1 and 2 (and others), in some embodiments, the track or groove 30 may also include a raised feature 54. In some embodiments, the raised feature 54 is triangular in shape. In other embodiments, it may be another shape, such as rectangular, circular or oval and so on. The raised feature 54 is configured to secure and/or limit the movement of a rack when the rack is placed in the track or groove 30.

The tray 5 may also include one or more cavities or chalk holders 35. The chalk holders 35 illustrated in FIGS. 1 and 2 are square in profile since chalk is generally square. In other embodiments, the cavities or chalk holders 35 may have a profile of another shape, such as rectangular or circular or rounded or other shape to accommodate a differently shaped piece of chalk. The depth of the chalk holders may vary between embodiments. In the present embodiment, one chalk holder 35 is provided to either side of the single indentation 10*a* in the supplemental area 20. In other embodiments, there may be only one chalk holder 35 or there may be greater than two chalk holders 35. The location of the chalk holder 35 may also vary between embodiments.

In the present embodiment, a handle 40 extends outward from the supplemental area 20 and is generally located above the single indentation 10*a* and the chalk holders 35. In one embodiment, the handle 40 has curved ends 44 and a flat upper and lower surface 46*a*, 46*b* which cooperate to define a void space 42, and is sized to allow a person's hand to fit into the void space 42. The handle 40 may be used to carry the empty tray 5 or to carry the case with items therein, when the tray is mated to a cover. The use of a cover is described in more detail below with reference to FIGS. 10-19.

As also shown in FIGS. 1 and 2, one or more depressions 50 may be formed in the tray 5. In the present embodiment, the depressions 50 are generally diamond-shaped and generally located at the junction 52 of the supplemental area 20 and the main body section 15 (e.g., generally at the bases of the handle 40). These diamond depressions 50 may redirect stresses incurred by picking up or carrying the tray 5 (or case, when paired with a cover) along the surface of the diamond depression 50. In this manner, the tray 5 may be less likely to crack when picked up and/or carried. The diamond depressions 50 effectively strengthen the tray 5 at junctures vulnerable to cracking or tearing.

As previously mentioned, the embodiment may include a base section 55 extending from the main body section 15. In the present embodiment, the base 55 generally extends from the angle of the main body section 15 that is opposite the supplemental area 20. The base section 55 not only provides mechanical strength to the tray 5 through increased surface area and thickness, but also provides a location for the cover to attach to the tray 5.

Figure 3:
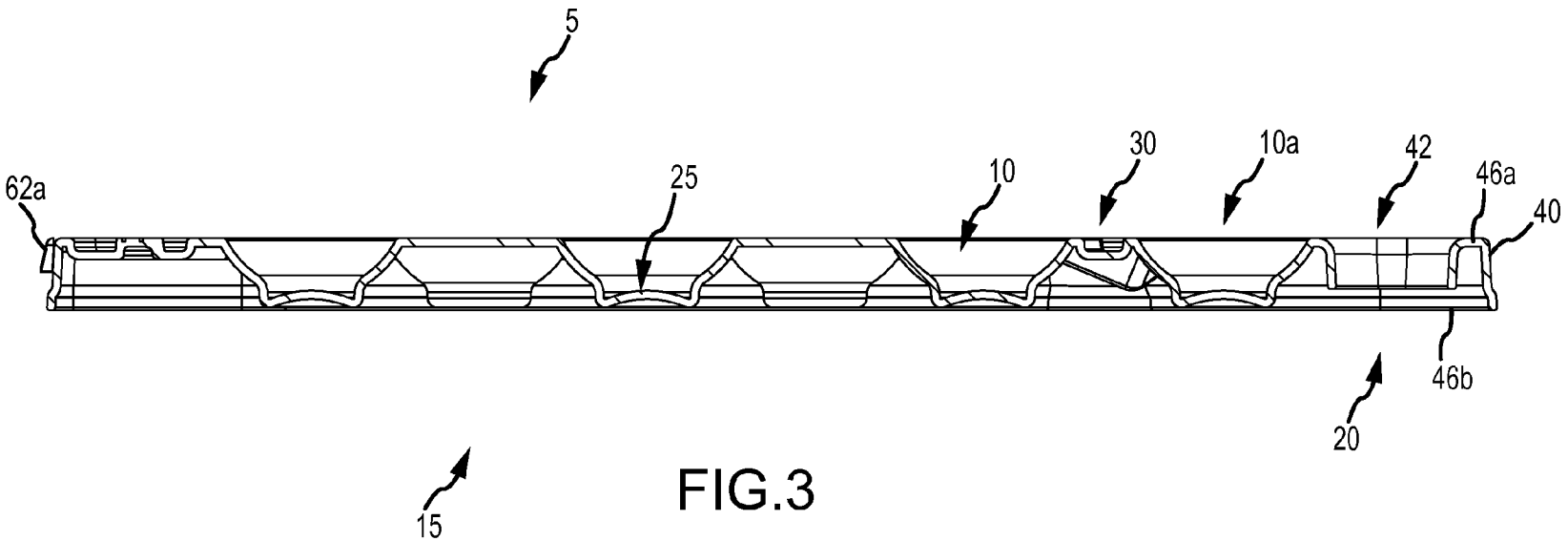
FIG. 3 is a cross-section of the billiards tray of FIG. 1, taken along section line 3-3 of FIG. 1.
Figure 4:
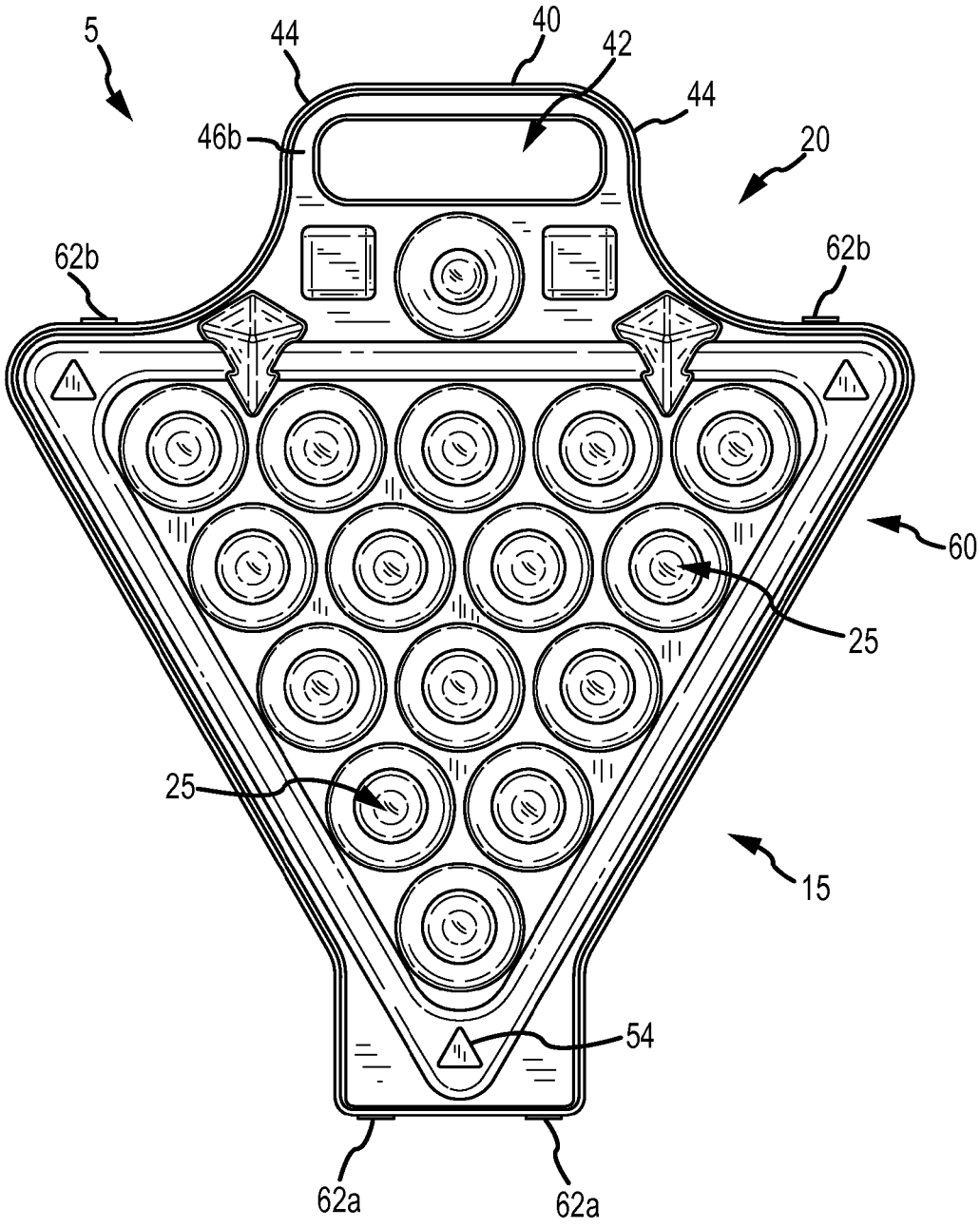
FIG. 4 is a bottom plan view of the billiards tray of FIG. 1.

FIG. 4 depicts the base 60 of the billiards tray 5. As shown to greater effect in this figure and FIG. 3, the convex bases 25 of each indentation 10 extend inward into the indentations themselves. The convex bases 25 are generally rounded and radiused to fit on top of billiard balls. It should be noted that the indentations 10 are sufficiently deep such that a billiard ball resting therein does not abut, or barely touches, the convex base 25.

Figure 5:
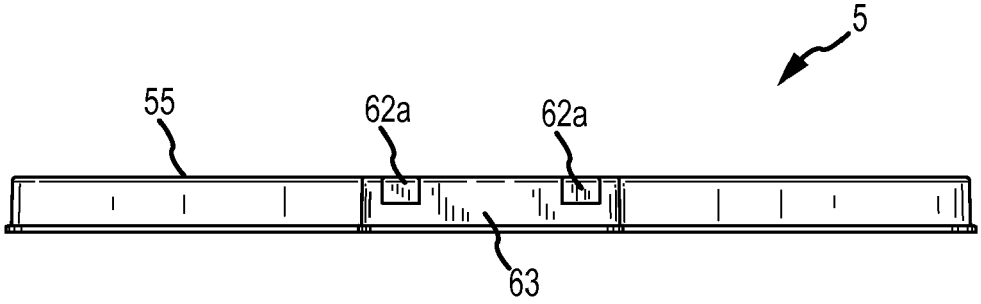
FIG. 5 is a front view of the billiards tray of FIG. 1.
Figure 6:
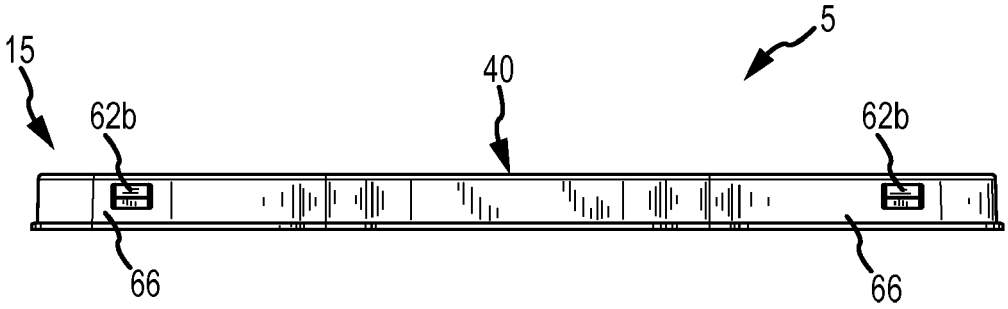
FIG. 6 is a rear view of the billiards tray of FIG. 1.

FIGS. 5 and 6 depict front and rear views of the tray 5, respectively. As shown in FIGS. 5 and 6, and with reference to FIGS. 1-4, the tray 5 may also include projections or detents 62. The detents 62 are configured to be received in apertures in a cover 80 that may be attached to the tray 5 to form a carrying case 65, as discussed in more detail with respect to FIGS. 10-19. In one embodiment, the detents 62 may be ramp-shaped. In other embodiments, the detents 62 may be any other suitable shape, such as rectangular or rounded protrusions. As indicated in FIG. 5, and with reference to FIGS. 1-4, in one embodiment, there are two detents 62*a* located generally on an outside face 63 of the base section 55 of the tray 5. In other embodiments, there may be only one detent or there may be greater than two detents. In other embodiments, the detents 62*a* may be on another face of the base section, such as a top face 64*a* or a side face 64*b*. As indicated in FIG. 6, and with reference to FIGS. 1, 3 and 4, in one embodiment, there are two detents 62*b* located generally on an outside face 66 of the main body section 15 of the tray 5. In other embodiments, there may be only one detent or there may be more than two detents. In other embodiments, the detents 62*b* may be on another face of the main body section 15, such as a top face 67.

Figure 7:
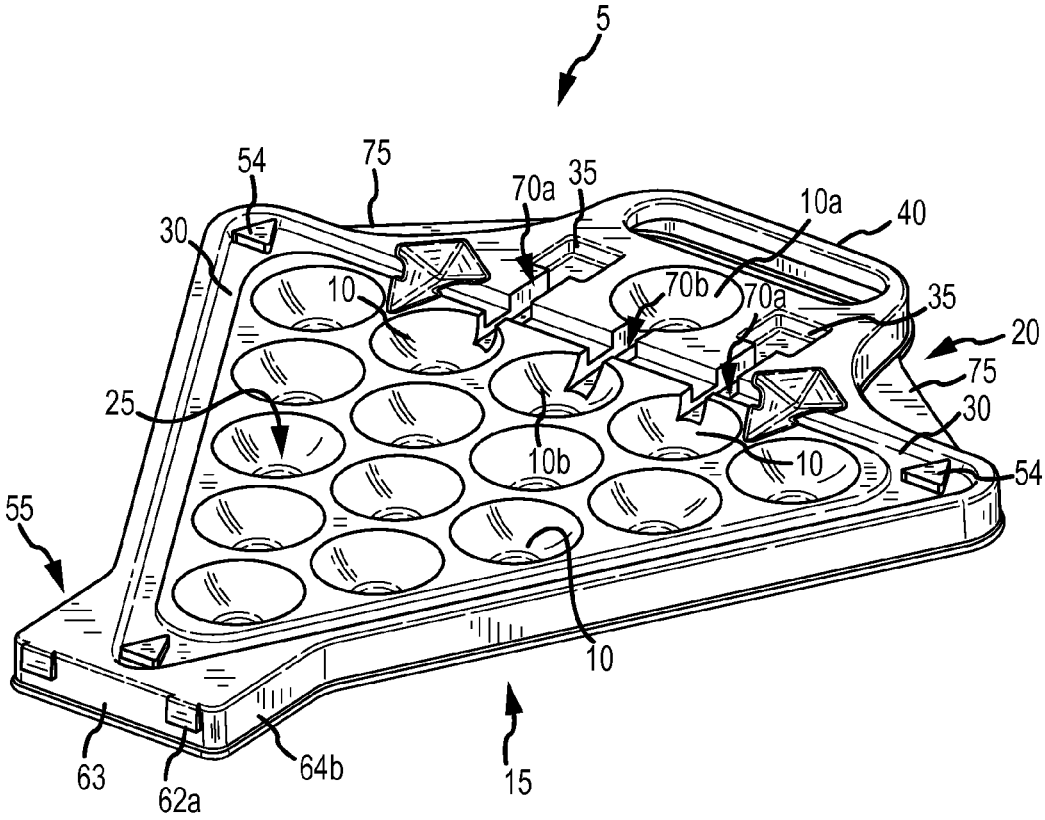
FIG. 7 is a perspective view of a second embodiment of a billiards tray.
Figure 8:
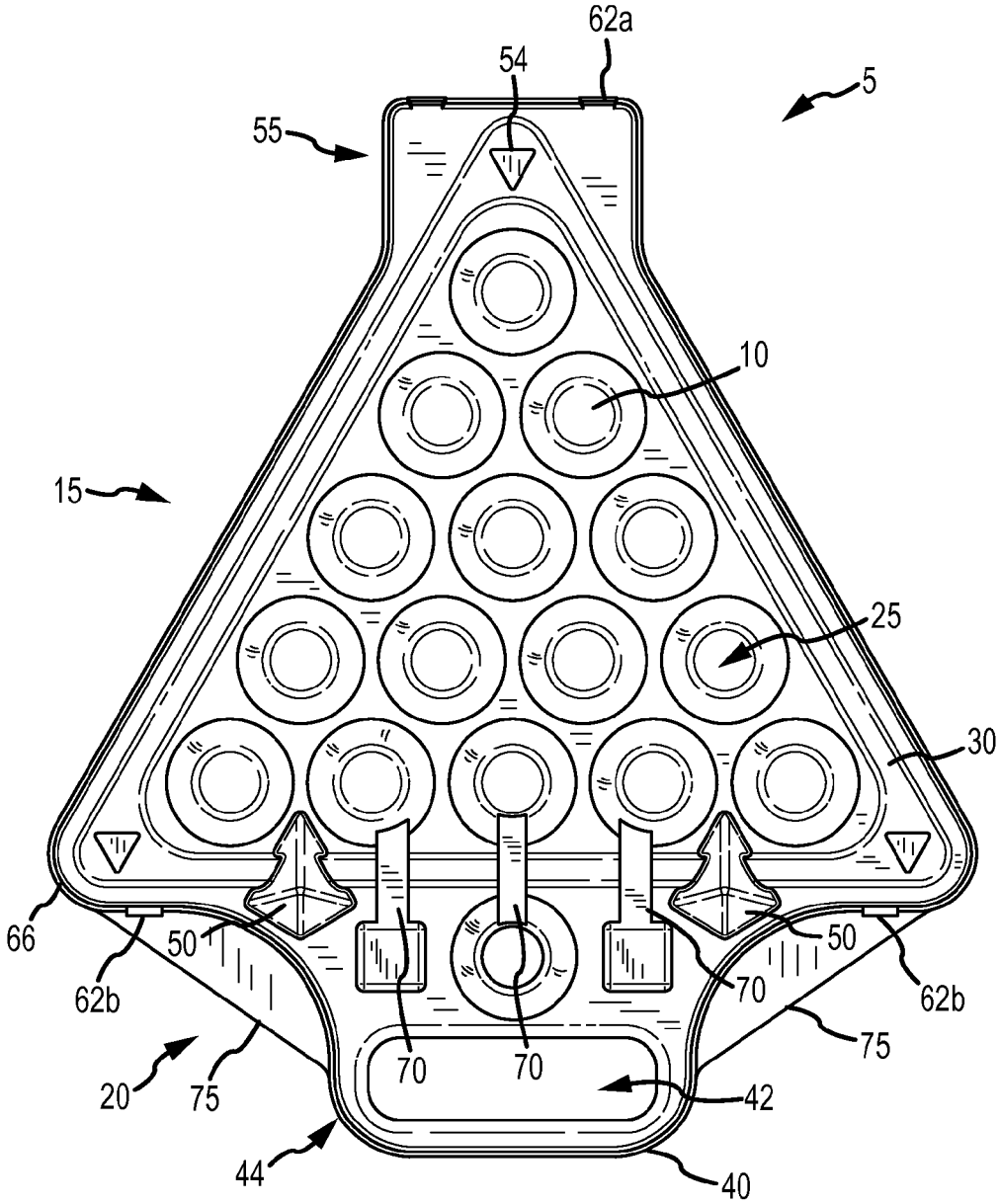
FIG. 8 is a top plan view of the billiards tray of FIG. 7.
Figure 9:
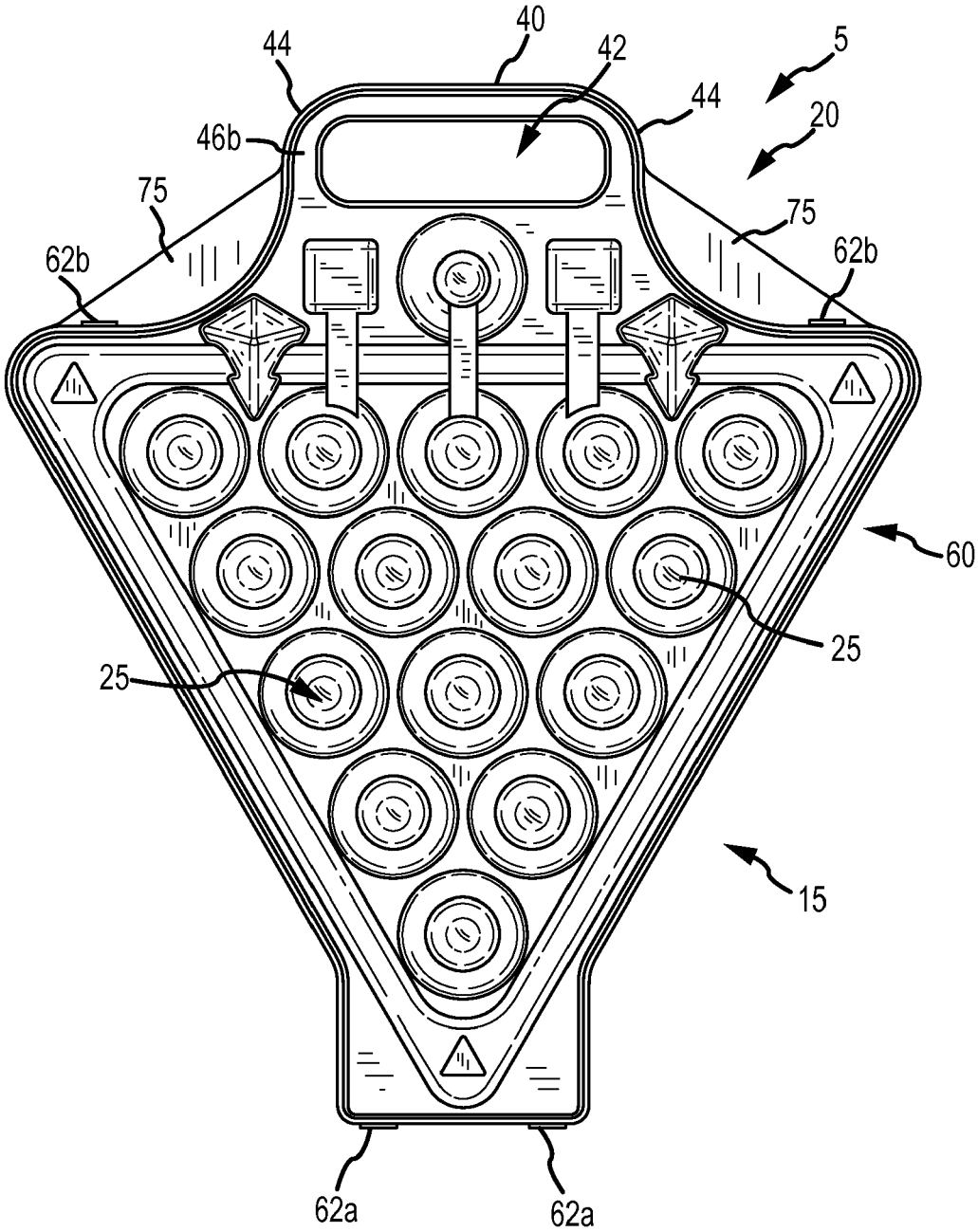
FIG. 9 is a bottom view of the billiards tray of FIG. 7.

For a discussion of a second embodiment of the tray 5, reference is now made to FIGS. 7-9. FIGS. 7-9 depict isometric, top and bottom views, respectively, of an embodiment of the tray 5 having channels 70 and reinforcement members 75. Other features of the tray 5 shown in FIGS. 7-9 may be similar to those discussed above with respect to FIGS. 1-6. As shown in FIGS. 7-9, channels 70*a* connect chalk holders 35 with an indentation 10. A channel 70*b* also connects an indentation 10*a* located in the supplemental area 20 with an indentation 10*b* located in the main body section 15. These channels 70 may redirect stresses incurred by picking up or carrying the tray 5 (or case, when paired with a cover) along the surface of the channel 70. In this manner, the tray 5 may be less likely to crack when picked up and/or carried. The channels 70 effectively strengthen the tray 5 at junctures vulnerable to cracking or tearing.

As shown in FIGS. 7-9, the tray 5 also includes reinforcement members 75. The reinforcement members 75 may also redirect stresses incurred by picking up or carrying the tray 5 (or case, when paired with a cover) along the surface of the reinforcement members 75. In this manner, the tray 5 may be less likely to crack when picked up and/or carried. The reinforcement members 75 effectively strengthen the tray 5 at junctures vulnerable to cracking or tearing.

Multiple trays 5 may be stacked one atop the other such that the tops of billiard balls carried in a first tray's indentations 10 rest in the convex bases 25 of a second tray. That is, as trays are stacked atop one another, the convex bases receive the tops of the billiard balls carried in the indentations of the tray beneath. Accordingly, the trays may be stably stacked one atop the other even with billiard balls in the tray. If the trays are empty, they may be stacked with one tray's indentations resting in the indentations of the tray beneath.

Figure 10:
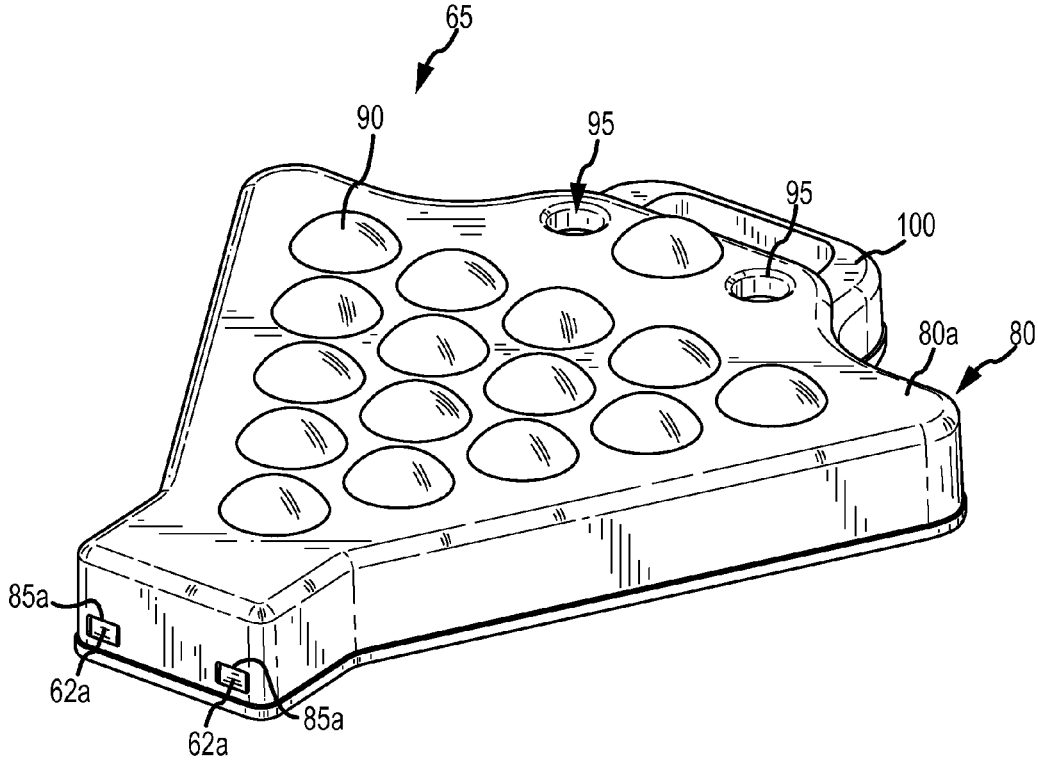
FIG. 10 is an isometric view of a cover attached to the billiards tray of FIG. 1.
Figure 11:
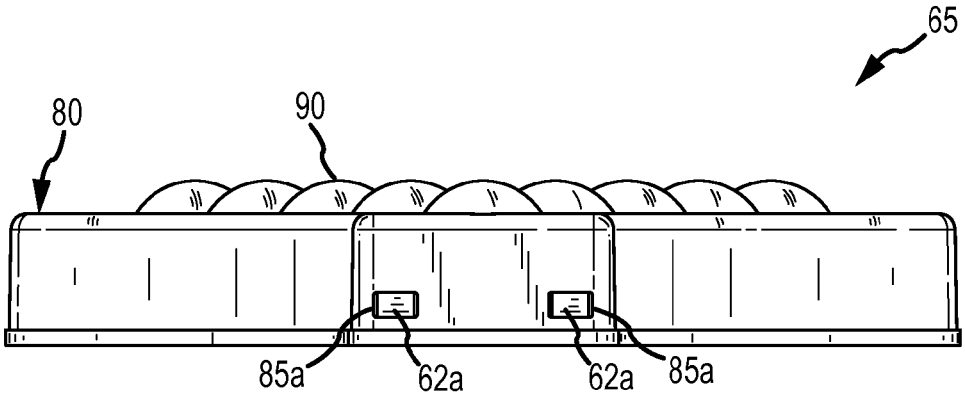
FIG. 11 is a front view of the cover and tray of FIG. 10.
Figure 12:
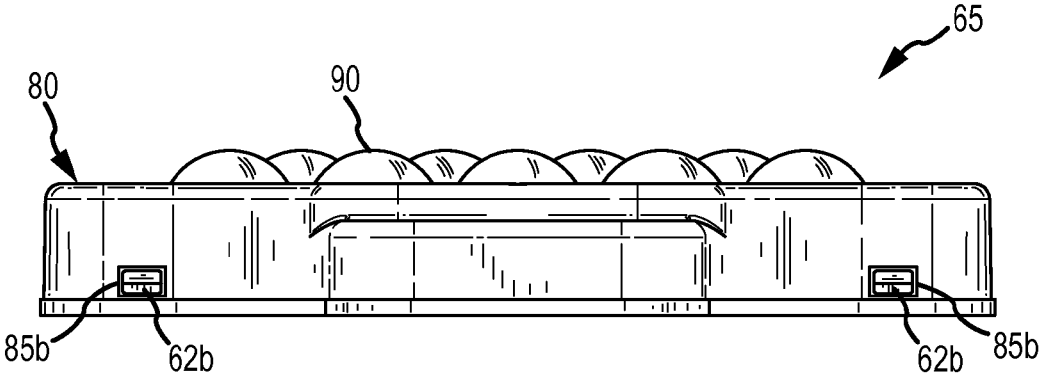
FIG. 12 is a rear view of the cover and tray of FIG. 10.
Figure 13:
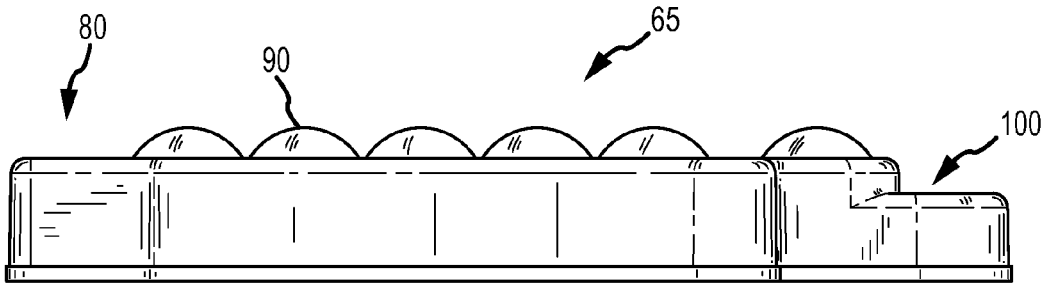
FIG. 13 is a right side view of the cover and tray of FIG. 10.
Figure 14:
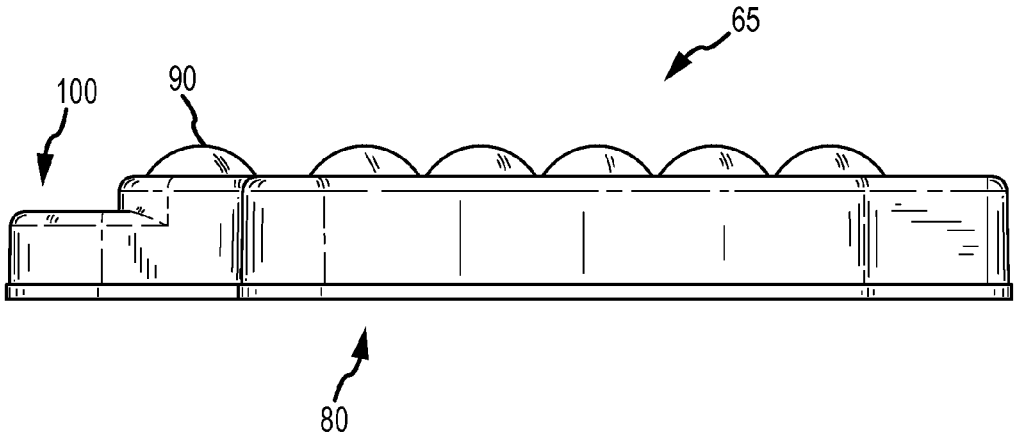
FIG. 14 is a left side view of the cover and tray of FIG. 10.
Figure 15:
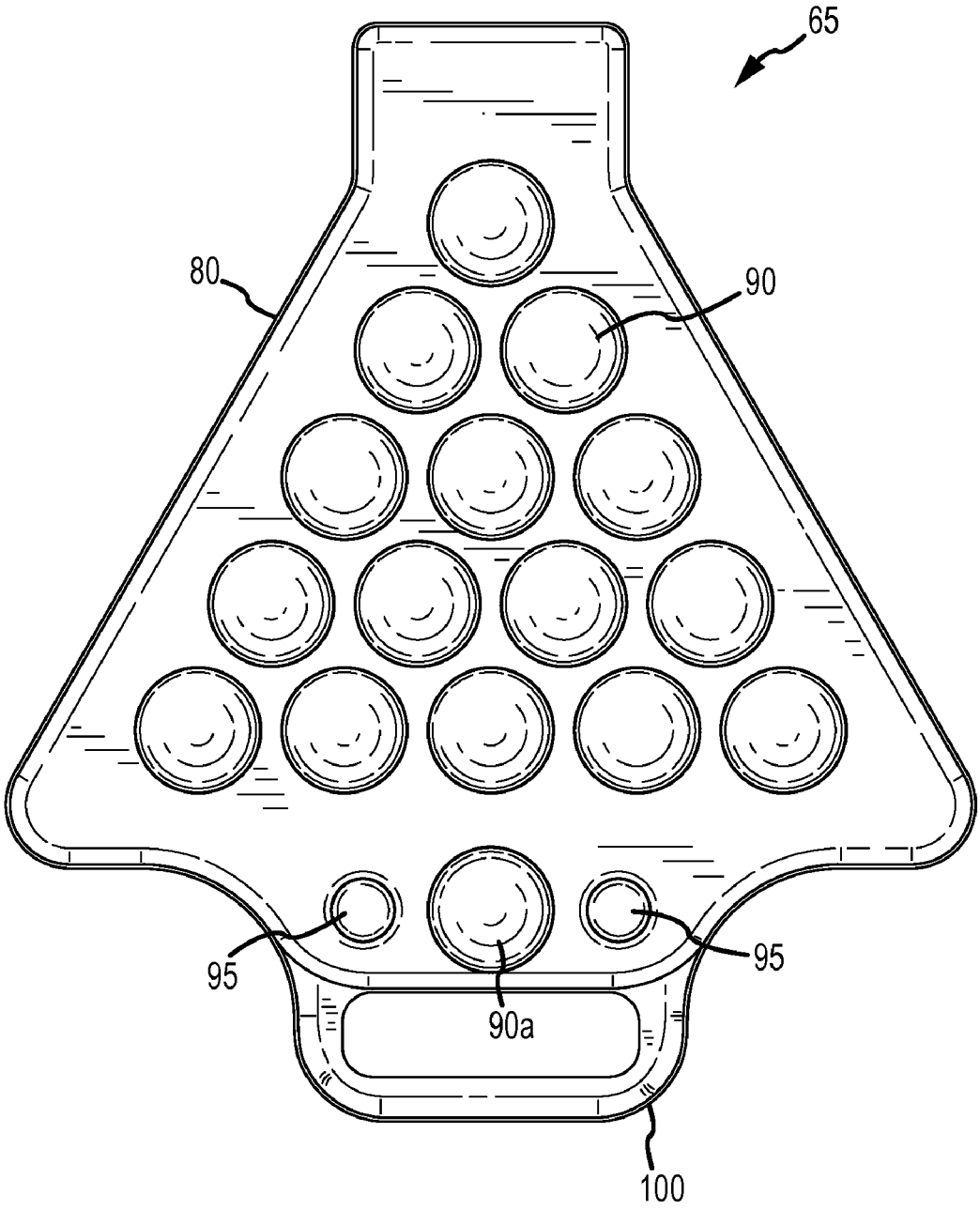
FIG. 15 is a top plan view of the cover and tray of FIG. 10.
Figure 16:
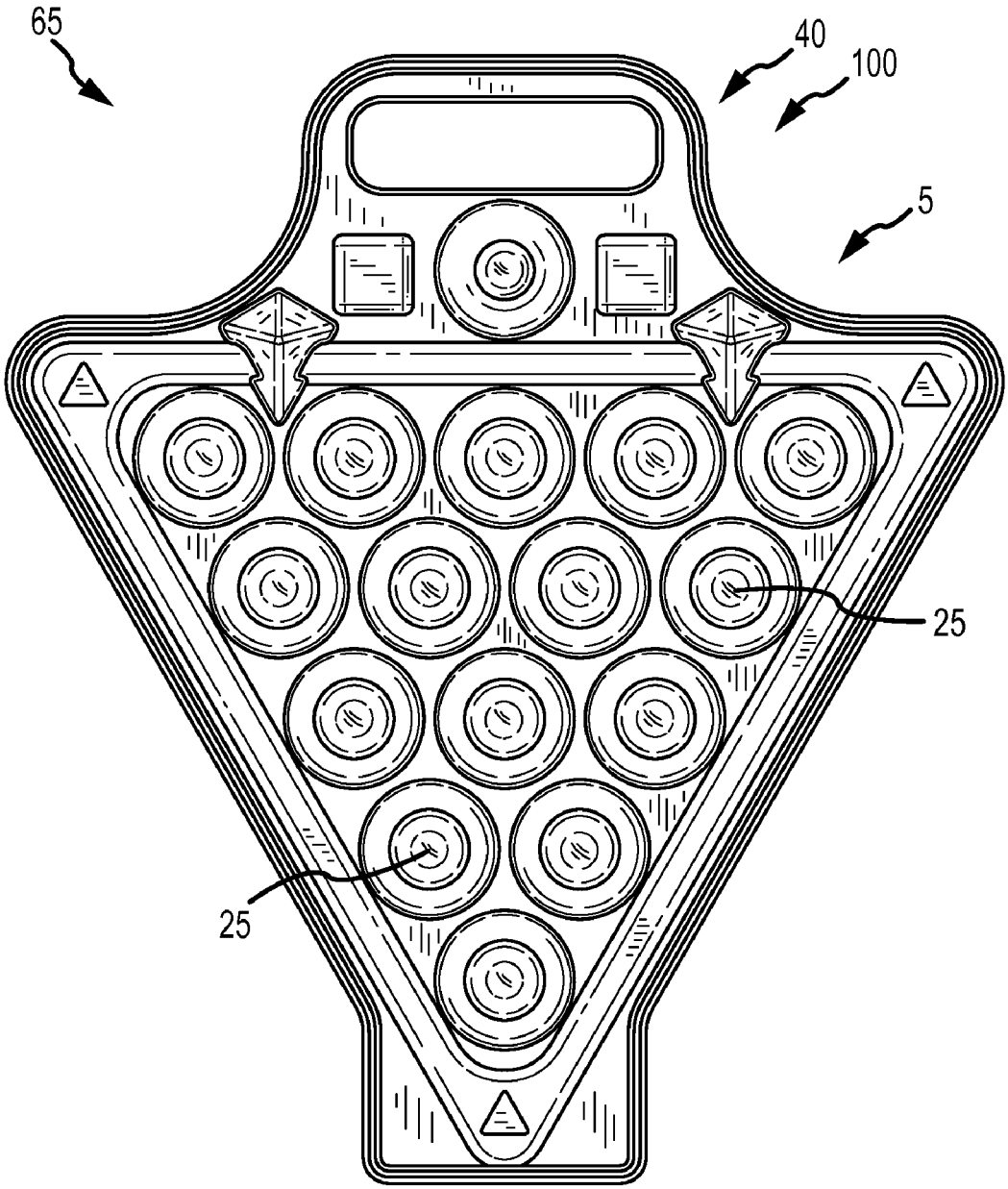
FIG. 16 is a bottom view of the cover and tray of FIG. 10.
Figure 17:
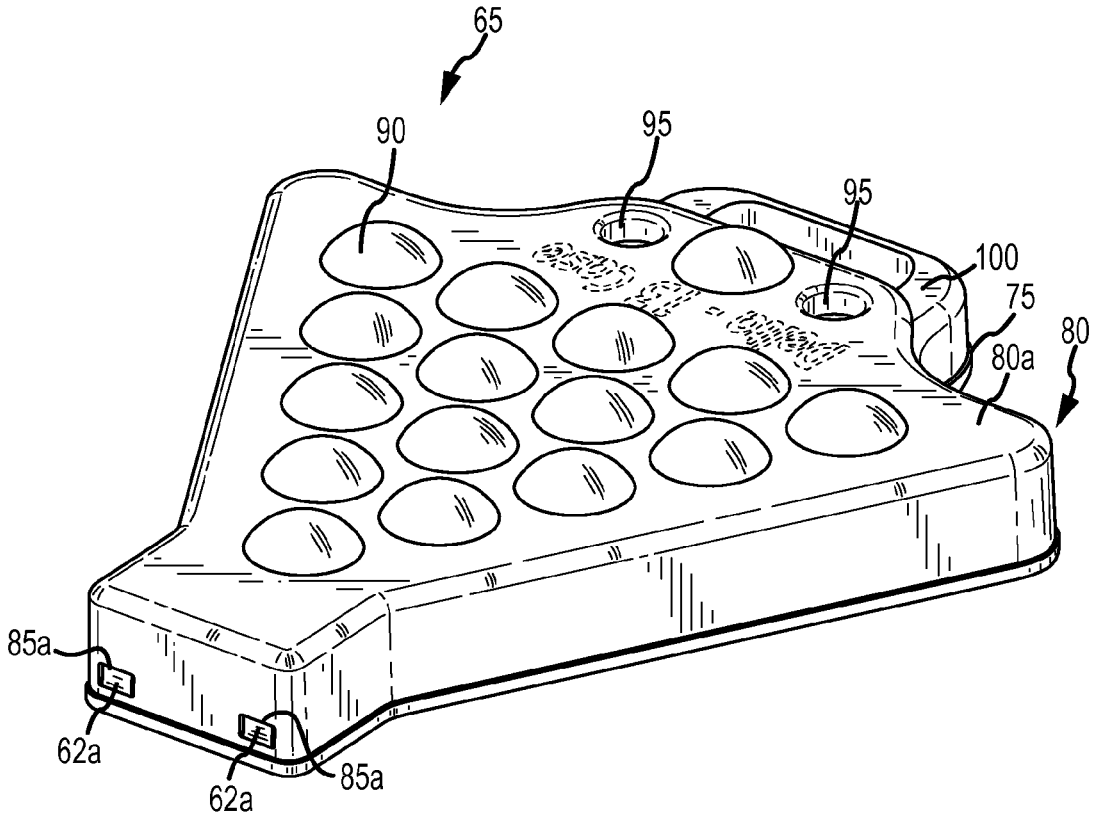
FIG. 17 is an isometric view of a cover attached to the billiards tray of FIG. 7.
Figure 18:
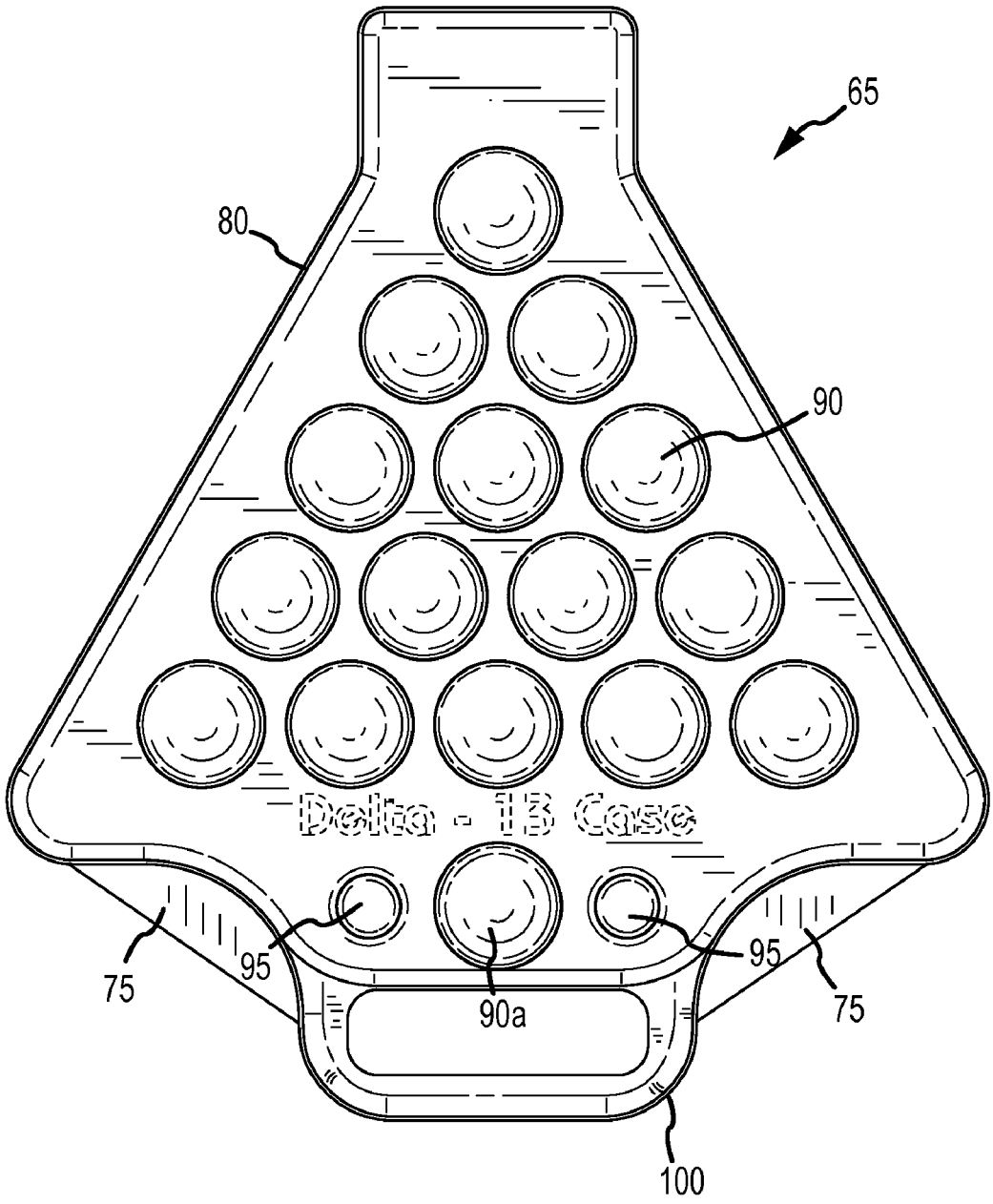
FIG. 18 is a top view of the cover and tray of FIG. 17.
Figure 19:
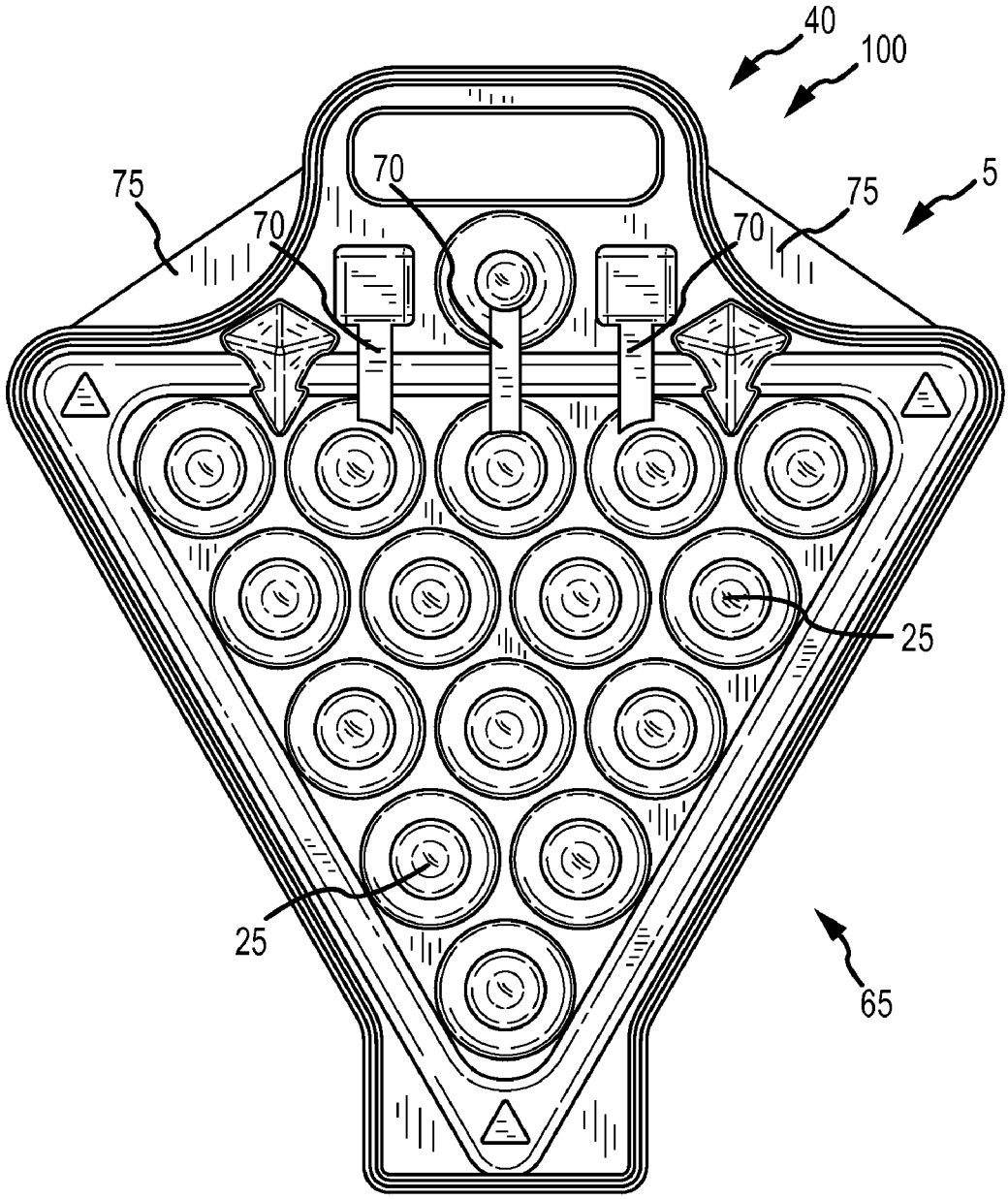
FIG. 19 is a bottom view of the cover and tray of FIG. 17.

FIGS. 10-16 depict a cover 80 mated to the tray 5 of FIGS. 1-6, thereby forming a carrying case. FIGS. 17-19 depict a cover 80 mated to the tray 5 of FIGS. 7-9, thereby forming a carrying case. Generally, FIG. 10 is an isometric view of the billiard carrying case 65. FIG. 11 is a front view of the carrying case 65, depicting the base section of the case. FIG. 12 is a rear view of the case 65 showing the handle. FIGS. 13 and 14 are right and left side views of the case 65, respectively. FIG. 15 is a top plan view and FIG. 16 is a bottom view of the case 65. FIGS. 17-19 depict isometric, top and bottom views, respectively, of the carrying case 65 mated to the second embodiment of the tray 5.

As previously mentioned, a cover 80 may be attached to the tray 5 to form the case. The cover 80 may be removably attached to the tray, such as by snap-fitting, in certain embodiments. As discussed above, and as can be understood from FIGS. 10-12 and 17, one or more detents or projections 62 may be formed on the tray 5 and the detents 62 are configured to be received in or otherwise mate with mating apertures 85 formed in the cover 80. Typically, apertures 85 having a similar or matching cross-section relative to the detent 62 are formed in the cover 80; each aperture 85 accepts a detent 62 when the cover 80 is placed atop the tray 5. The protrusions 62 are sized such that they extend through the apertures 85 and hold the cover 80 to the tray 5 relatively snugly. The cover 80 may be removed from the tray 5 by flexing the cover 80 outward so that a sidewall of an aperture 85 deforms sufficiently to permit removal of the protrusion 62 from the aperture 85. It should be noted that each such aperture 85 may be deformed separately from one another, or certain sets of apertures 85 may be deformed simultaneously.

In the present embodiment, and with reference to FIG. 1, two protrusions 62*b* are formed on the sides of the tray 5 near the supplemental area 20 and two protrusions 62*a* are formed on the base section 55. The two side protrusions 62*b* can be seen to best effect in FIG. 2, while FIG. 12 shows the protrusions 62*b* mated with corresponding apertures 85*b*. FIG. 3 depicts the base protrusions 62*a*, which can be seen within the base apertures 85*a* in FIG. 11. Some embodiments may employ alternative ways to attach or removably attach the cover to the tray, such as a hinge, flaps, screws or other mechanical attachments, friction-fittings, one or more wrap-around features, and so on.

As depicted generally in FIGS. 10 and 15, the top of the case 65 includes convex, partially-spherical shaped projections 90 matching the placement of the indentations 10 formed in the tray 5. In this manner, the cover 80 may fit over billiard balls carried in the tray 5 when the cover 80 is snap-fitted or otherwise mated to the tray 5. Further, these convex projections 90 may fit into the convex base of an adjacent tray when the trays are stacked. Further, cases 65 may be stacked atop one another, the convex bases of one tray receive the tops of the projections 90 of the cover 80 of the case 65 beneath. Accordingly, the cases may be stably stacked one atop the other even with billiard balls in the tray. FIG. 16, for example, shows the convex bases of the case 65 formed by the combination of tray 5 and cover 80.

As shown in FIGS. 13-15 (and others), it can be seen that the top cover 80 includes round impressions 95 formed to either side of the single spherical projection 90*a*, near the handle 100. These impressions 95 extend downward or laterally from a top surface 80*a* of the cover 80. Generally, the impressions 95 overlay the chalk holders 35 formed in the tray 5 when the tray 5 and cover 80 are mated. The impressions 95 extend downward or laterally sufficiently far to prevent chalk held in the chalk holder 35 from becoming dislodged when the cover 80 and tray 5 are mated.

A handle 100 may also be formed in the cover 80 in such a manner as to generally correspond to the handle 40 formed in the tray 5. This handle 100 is shown to best effect in FIGS. 15 and 18.

FIGS. 17-19 depict a case 65 with features as described above with respect to FIGS. 10-16, except the tray 5 includes features as described with respect to FIGS. 7-9. That is, and as shown in FIGS. 17-19, the tray 5 includes channels 70 (see FIG. 19) and reinforcement members 75 (see FIGS. 17-19), both configured to strengthen or add additional rigidity to the carrying case 65.

The tray 5 and cover 80 may be made from a variety of materials, such as plastics, composites, metals, wood and so on. In the present embodiment, the cover 80 may be made from a thermoplastic such as glycol-modified polyethylene terephthalate (PETG) and the tray 5 from a thermoplastic such as acrylonitrile butadiene styrene (ABS). PETG is a thermoplastic polyester with good impact strength and a high stiffness, toughness and hardness which may be molded or otherwise formed into the shape of the cover. ABS provides strength and rigidity at a relatively light weight and may be easily molded into the shapes of the tray. In alternative embodiments, both the tray and cover may be made from the same material or different materials.

All directional references (e.g., upper, lower, upward, downward, left, right, leftward, rightward, top, bottom, above, below, inner, outer, vertical, horizontal, clockwise and counterclockwise) are only used for identification purposes to aid the reader's understanding of the example(s), and do not create limitations, particularly as to the position, orientation or use unless specifically set forth in the claims. Joinder references (e.g., attached, coupled, connected, joined, and the like) are to be construed broadly and may include intermediate members between a connection of elements and relative movement between elements. As such, joinder references do not necessarily infer that two elements are directly connected and in fixed relation to each other.

Although the embodiments described herein have been discussed with respect to certain physical structures, dimensions, materials and the like, it should be understood that alternative embodiments may vary in certain respects without departing from the spirit, scope or understanding of the disclosure. Accordingly, the proper scope of protection is defined by the appended claims.

We claim:

1. An apparatus for carrying a set of balls and a rack, comprising:

a tray comprising:

a plurality of indentations formed in a surface of the tray, each indentation at least partially spherical and including a convex base and configured to receive a ball;

a groove formed in the surface of the tray, the groove configured to receive a rack; and a handle formed in the surface of the tray, wherein: the plurality of indentations comprises sixteen indentations;

a set of fifteen indentations of the plurality of indentations are arranged in a pattern;

the groove surrounds the set of fifteen indentations; and the sixteenth indentation is placed outside the groove.

2. The apparatus of claim 1, wherein the groove is a triangular-shaped groove and is configured to receive a triangular rack.

3. The apparatus of claim 2, wherein the triangular-shaped groove is formed about fifteen indentations arranged in a triangular pattern.

4. The apparatus of claim 1, wherein each of the convex bases extends upwardly and at least partially into the indentation.

5. The apparatus of claim 4, wherein:

the indentations and groove are formed in a main body segment of the tray; and the handle extends outwardly from a side of the main body segment.

6. The apparatus of claim 5, further comprising at least one depression formed at a junction of the handle and the main body segment.

7. The apparatus of claim 6, wherein the at least one depression redirects a stress caused by carrying the tray by the handle.

8. The apparatus of claim 1, further comprising at least one cavity configured to receive a piece of chalk.

9. The apparatus of claim 1, wherein the pattern in which the set of fifteen indentations is arranged is selected from the group consisting of a triangular pattern, a rectangular pattern, a square pattern and a rounded pattern.

10. The apparatus of claim 1, wherein the tray is selected from the group consisting of a generally triangular-shaped tray, a generally square-shaped tray and a generally rectangular-shaped tray.

11. A case for carrying a set of billiard balls and a billiards rack, comprising:

a tray; and a cover; wherein the tray and cover are attached to one another;

each single ball of a set of billiard balls is held within the case when the tray and cover are attached to one another; and the case is configured to carry the billiards rack when the tray and cover are attached to one another, wherein a plurality of at least partially spherical indentations are formed in the tray, each indentation having a convex base;

a plurality of at least partially spherical projections are formed in the cover; and the plurality of at least partially spherical indentations and the plurality of at least partially spherical projections cooperate to form a plurality of at least partially spherical spaces, each space configured to accept a single billiard ball of the set of billiard balls, wherein: the plurality of indentations comprises sixteen indentations;

a set of fifteen indentations of the plurality of indentations are arranged in a pattern;

a groove surrounds the set of fifteen indentations; and the sixteenth indentation is placed outside the groove.

12. The case of claim 11, further comprising a triangular groove formed in the tray and configured to receive the billiards rack.

13. The case of claim 12, wherein the case is selected from the group consisting of a generally triangular-shaped case, a generally square-shaped case and a generally rectangular-shaped case.

14. The case of claim 11, wherein the case comprises:

a main body section; and a handle extending from the main body section; wherein the cover and tray cooperate to form the main body section and the handle.

15. The case of claim 14, further comprising a base section extending from one point of the main body section.

16. The case of claim 11, wherein the cover snap-fits to the tray.

17. The case of claim 16, wherein:

a plurality of protrusions is formed in the tray;

a plurality of apertures is formed in the cover; and the apertures receive the protrusions when the cover snap-fits to the tray.

* * * * *